US009748688B2

(12) United States Patent
Hagmann et al.

(10) Patent No.: US 9,748,688 B2
(45) Date of Patent: Aug. 29, 2017

(54) PLUG-AND-SOCKET CONNECTOR HAVING A MOVABLE CLOSURE ELEMENT

(71) Applicant: ITT Manufacturing Enterprises, LLC, Wilmington, DE (US)

(72) Inventors: Bernd Hagmann, Bad Ueberkingen (DE); Helmut Singer, Bad Ditzenbach (DE); Martin Littek, Kernen (DE)

(73) Assignee: ITT MANUFACTURING ENTERPRISES, LLC, Wilmington, DE (US)

( * ) Notice: Subject to any disclaimer, the term of this patent is extended or adjusted under 35 U.S.C. 154(b) by 0 days.

(21) Appl. No.: 15/214,279

(22) Filed: Jul. 19, 2016

(65) Prior Publication Data

US 2017/0025786 A1 Jan. 26, 2017

(30) Foreign Application Priority Data

Jul. 21, 2015 (DE) ..... 10 2015 213 734

(51) Int. Cl.

| | |
|---|---|
| ***H01R 13/44*** | (2006.01) |
| ***H01R 13/52*** | (2006.01) |
| ***H01R 13/453*** | (2006.01) |
| ***H01R 13/187*** | (2006.01) |
| *H01R 13/11* | (2006.01) |

(52) U.S. Cl.

CPC ..... *H01R 13/5213* (2013.01); *H01R 13/187* (2013.01); *H01R 13/4538* (2013.01); *H01R 13/111* (2013.01)

(58) Field of Classification Search

CPC ..... H01R 13/4538; H01R 13/453; H01R 13/5213

USPC ..... 439/140, 141

See application file for complete search history.

(56) References Cited

U.S. PATENT DOCUMENTS

| | | | | |
|---|---|---|---|---|
| 3,491,326 | A * | 1/1970 | Pfister | H01R 13/4538 439/141 |
| 3,508,188 | A | 4/1970 | Buck | |
| 4,094,565 | A | 6/1978 | Parrier et al. | |
| 4,142,770 | A * | 3/1979 | Butler, Jr. | H01R 13/523 439/140 |
| 5,151,040 | A | 9/1992 | Tanaka | |

(Continued)

FOREIGN PATENT DOCUMENTS

| | | |
|---|---|---|
| DE | 1 202 374 A | 10/1965 |
| DE | 26 56 214 A1 | 6/1977 |

(Continued)

OTHER PUBLICATIONS

European Search Report dated Dec. 13, 2016, received in related EP Application No. 16176242.2; 9 pages.

(Continued)

*Primary Examiner* — Hae Moon Hyeon

(74) *Attorney, Agent, or Firm* — Knobbe, Martens, Olson & Bear LLP

(57) ABSTRACT

A plug-and-socket connector with an electrically conductive female contact for receiving a contact pin and for establishing an electrically conductive connection to the contact pin is described. According to implementations here, the female contact is accessible by an opening in the plug-and-socket connector. Further, a closure element for closing the opening is movably supported inside the female contact.

11 Claims, 4 Drawing Sheets

(56) References Cited

U.S. PATENT DOCUMENTS

| | | | | |
|---|---|---|---|---|
| 6,309,231 | B1 * | 10/2001 | Gordon | H01R 13/4538 439/140 |
| 6,494,728 | B1 * | 12/2002 | Gorman | H01R 13/4538 174/66 |
| 6,767,228 | B2 * | 7/2004 | Katz | H01R 13/4538 439/134 |
| 7,140,891 | B1 * | 11/2006 | Huang | H01R 12/716 439/137 |
| 7,322,859 | B2 * | 1/2008 | Evans | H01R 13/625 439/140 |
| 7,500,859 | B2 * | 3/2009 | Dubranna | H01R 13/523 439/140 |
| 7,972,173 | B1 * | 7/2011 | Hyzin | H01R 13/2421 439/578 |
| 2006/0148338 | A1 | 7/2006 | Virchow | |
| 2016/0380384 | A1 * | 12/2016 | Umehara | H01R 24/58 439/140 |

FOREIGN PATENT DOCUMENTS

| | | |
|---|---|---|
| DE | 10 2006 025 611 B3 | 12/2007 |
| EP | 24 77 281 | 7/2012 |

OTHER PUBLICATIONS

Examination Report dated Mar. 14, 2016, in counterpart German patent application No. 10 2015 213 734.1 and machine-language translation thereof; 6 pages.

* cited by examiner

PLUG-AND-SOCKET CONNECTOR HAVING A MOVABLE CLOSURE ELEMENT

CROSS-REFERENCE TO RELATED APPLICATIONS

This application claims priority to German Patent Application No. DE 201510213734 20150721, filed Jul. 21, 2015, published as DE 102015213734, which is hereby incorporated by reference in its entirety.

BACKGROUND

Field

The invention relates to a plug-and-socket connector.

Description of Related Art

A contact holder for a plug or a socket is known from DE 10 2006 025 611 B3 in which a protective part on a front side comprises a sealing cap. The sealing cap comprises passages for contacts.

DE 1 202 374 A discloses an electrical coupling consisting of two coupling parts. The live contacts are covered in the two coupling parts in the non-coupled state. The current supply for the contact constructed as a sliding contact takes place via lines which are connected to clamping screws and are run through bores. A casing, the clamping screws and the current supply lines are covered by a cylindrical hood arranged concentrically to the casing.

Various drawbacks in the art, however, may be solved by the innovative plug-and-socket connectors herein.

BRIEF DESCRIPTION OF THE DRAWINGS

Exemplary embodiments of the invention are explained in the following with reference made to the drawings. In the drawings.

OVERVIEW OF SOME ASPECTS

Figure 1:
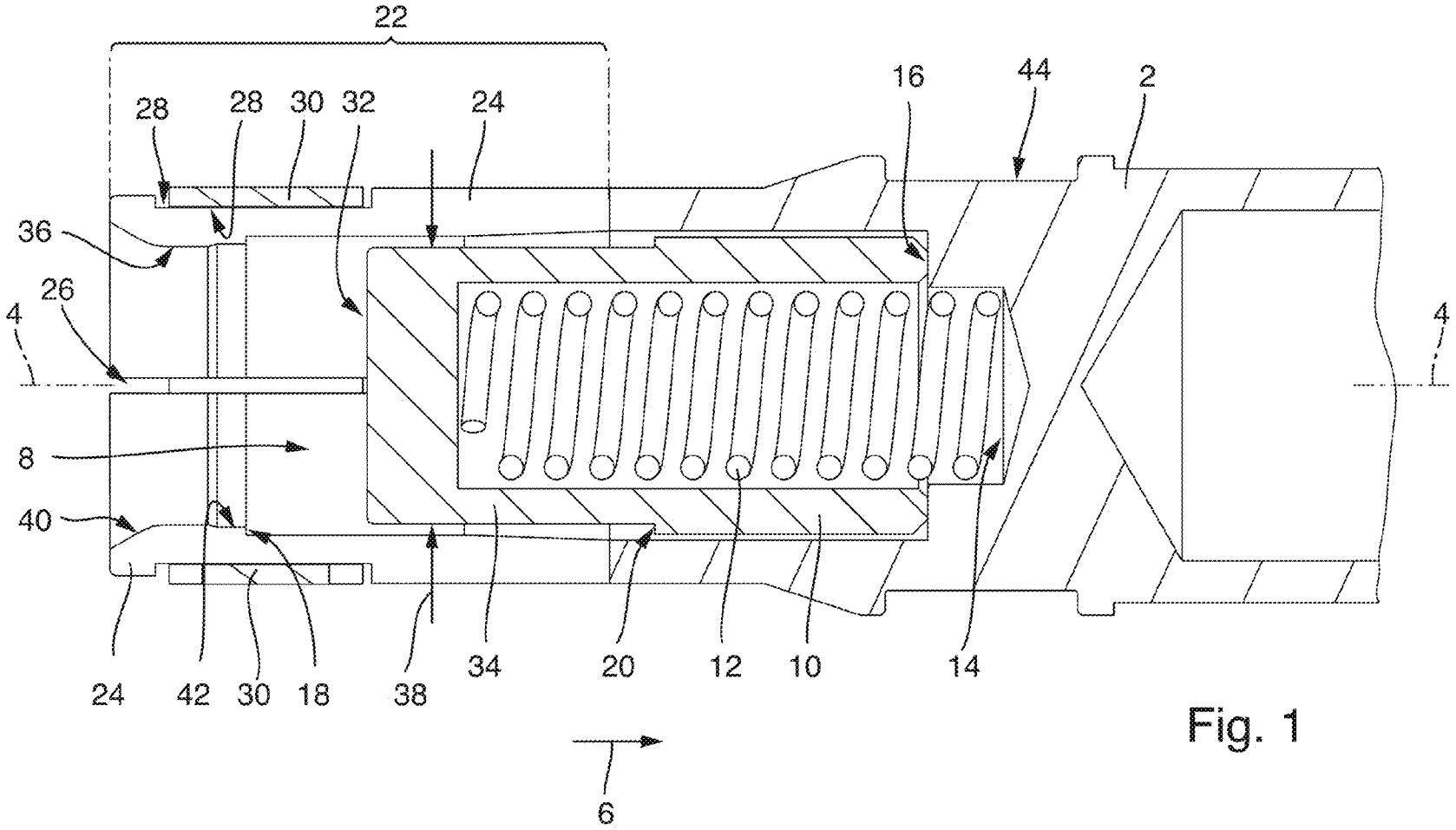
FIG. 1 shows a schematic sectional view of an implementation of an illustrative female contact, consistent with one or more aspects of the innovations herein.

According to aspects of the innovations herein, as a result, inter alia, of features involving a closure element for closing an opening being movably supported inside an electrically conductive female contact, a contact pin can be advantageously encompassed, on the one hand, radially outside and, on the other hand, the opening can be advantageously closed, as a result of which contact protection is created. Furthermore, entry of contamination into the area of the female contact is prevented by the closure element. Also, a construction of the plug-and-socket connector may be realized which is protected against water spray and is watertight.

An advantageous embodiment may involve the closure element being supported by a first pretensioning device and an opposed section. The first pretensioning device presses the closure element in the direction of the opening. As a result, the opening is advantageously closed when no contact pin is inserted.

In another advantageous embodiment, a second pretensioning device encompasses a contact section of the female contact at least in sections. As a result, the contact section is radially compressed and therefore a pretensioning force is always made available for establishing the electrical contact with the contact pin.

In an advantageous embodiment, a distal section of the closure element may be constructed as an outer support to the second pretensioning device. This advantageously brings it about that the spring path of the second pretensioning device can be made small, which has an advantageous effect on the design of the second pretensioning device and therefore the contact force for the contacting of the contact pin can be precisely adjusted in an advantageous manner and is not substantially diminished during the service life of the plug-and-socket connector.

In one advantageous embodiment, the distal section of the closure element may have an outside diameter which substantially corresponds to an outside diameter of the contact pin to be received and/or to an inside diameter of the opening. Therefore, the closure element advantageously functions for closing the opening as well as an outer support for the second pretensioning device.

In an advantageous embodiment, the distal section of the closure element may have an increase of diameter in the direction of insertion wherein the increase of diameter corresponds to the contact section in such a manner that the contact section opens in advance upon an insertion procedure.

This can advantageously prevent the tip of the contact pin touching the female contact. This avoids wear in the area of the pin tip, and the contact pin is therefore preferably contacted in an area which has a uniform outside diameter.

In an advantageous embodiment, the distal section of the closure element may have a decrease of diameter in the direction of insertion after the increase of diameter. This advantageously brings it about when the opening is closed by the closure element that the second pretensioning device is in a relaxed position opposite the pre-open position.

In another advantageous embodiment, the female contact may be arranged in an insulating body. The opening is designed in a sealing element, especially made of silicone, and different from the insulating body. In this manner a coordination of material of the sealing element and of the closure element is advantageously possible for closing the opening. In particular, a watertight design of the plug-and-socket connector may also be realized.

In an advantageous embodiment, material(s) which define (s) the opening and the closure element may be constructed in an insulating manner. This advantageously creates the contact and touching protection of the plug-and-socket connector.

Other features, possibilities of use and advantages of the invention result from the following description of exemplary embodiments of the invention which are shown in the figures of the drawings. The same reference numerals are used for functionally equivalent magnitudes and features in all figures even in different embodiments.

DETAILED DESCRIPTION OF ILLUSTRATIVE IMPLEMENTATIONS

FIG. 1 shows a schematic sectional view of an electrically conductive female contact 2 of a plug-and-socket connector, according to one illustrative implementation herein. The female contact 2 is constructed substantially rotationally symmetrically to a central longitudinal axis 4. The female contact 2 is constructed in a plugging direction 6 for receiving a contact pin, which is not shown, into a receiving chamber 8. Furthermore, the female contact 2 is constructed for establishing an electrically conductive connection between the female contact 2 and the contact pin. The female contact 2 is arranged inside the plug-and-socket connector and is accessible through an opening in the plug-and-socket connector, as is explained in the following.

In order to close the previously explained opening a preferably electrically non-conductive or electrically insulating closure element 10 is movably supported inside the female contact 2. The closure element 10 is supported by a first pretensioning device 12 on an opposing section 14 of the female contact 2. The first pretensioning device 12 presses the closure element 10 counter to the plugging direction 6. In the position shown the closure element 10 is located in the plugging direction 6 on a stop 16 of the female contact 2 which limits the movement of the closure element 10 in plugging direction 6. For reasons of clarity the contact pin is not shown in this particular drawing, though is shown elsewhere herein. The movement of the closure element 10 counter to the plugging direction 6 is limited by another stop 18 and a diameter break 20 of the closure element 10. If the diameter break or stop 20 rests on the stop 18 then the closure element 10 extends sectionally out of the female contact 2 and closes the previously cited opening of the plug-and-socket connector.

The female contact 2 comprises a contact section 22 counter to the plugging direction 6. The contact section 22 comprises contact webs 24 separated from each other by notches 26. The contact webs 24 have an outer annular groove 28 oriented transversely to the central longitudinal axis 4 in which a second pretensioning device 30 with the shape of an annular spring is arranged. The second pretensioning device 30 therefore encompasses the contact section 22 at least in sections in order to compress the contact section 22 radially in the direction of the central longitudinal axis 4.

The contact pin presses the distal closure surface 32 of the closure element 10 when introduced in the plugging direction and therefore moves the closure element 10 in the plugging direction 6. Without a supplied contact pin the closure element is moved counter to the plugging direction 6, as a result of which a distal section 34 rests with its cylindrical outer wall on an inner contact surface 36 and therefore forms an outer support for the second pretensioning device 30. To this end the distal section 34 has an outside diameter 38.

The contact area 22 has a distal introductory slope 40 for the contact pin. An introductory area 42 for the closure element 10 follows the inner contact surface 36 in the plugging direction 6. Furthermore, the female contact 2 has an annular fastening groove 44 for arrangement in an insulating body.

Figure 2:
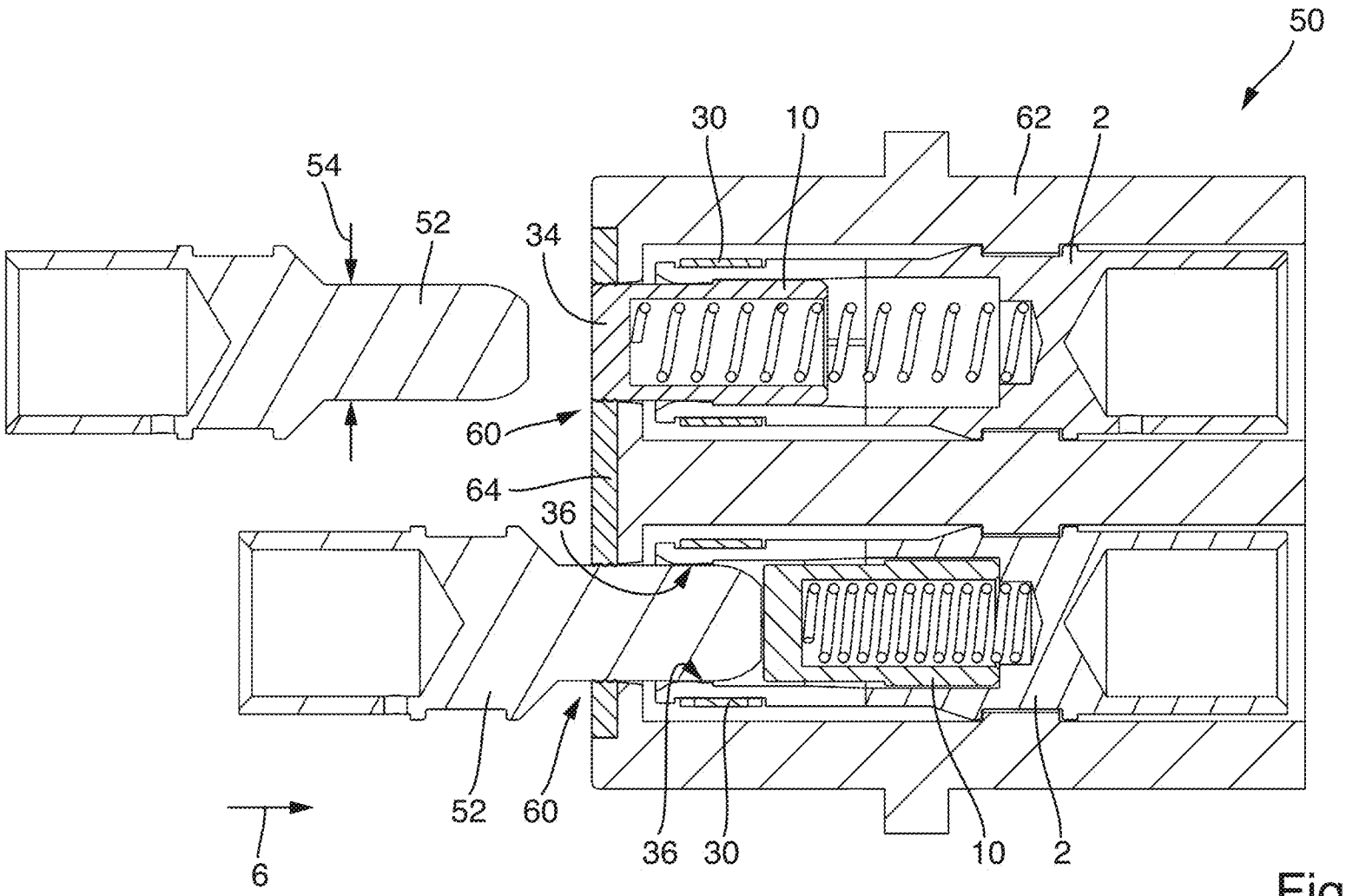
FIG. 2 show a schematic sectional view involving an illustrative plug-and-socket connector with the female contact, consistent with one or more aspects of the innovations herein.

FIG. 2 schematically shows a sectional view of a plug-and-socket connector 50 wherein a particular contact pin 52 for explaining the function of the female contact 2 is shown, according to one illustrative implementation herein. The female contacts 2*a* and 2*b* according to the construction in FIG. 1 are received in the plug-and-socket connector 50. The distal section 34 of the closure element 10 has the outside diameter 38 which substantially corresponds to an outside diameter 54 of the contact pin to be received and/or to an inside diameter of the opening 60. The plug-and-socket connector 50 comprises an insulating body 62 in which the female contact 2 is arranged substantially in a stationary manner.

The opening 60 is closed by the closure element 10 when contact pin 52 is not supplied. If the contact pin 52 is supplied in plugging direction 6 the closure element 10 moves in plugging direction 6. At this time the closure element 10 frees the inner contact surfaces 36 of the contact section 22 and the inner contact surfaces 36 can encompass the contact pin 52.

Furthermore, the plug-and-socket connector 50 comprises a sealing element 64 in which the opening 60 is constructed. The sealing element 64 is connected to the insulating body 62 in a substantially stationary manner but has a higher elasticity in comparison to the insulating body 62 in order to cooperate in such a manner with the closure element 10 that the opening 60 can preferably be closed in a watertight manner. Of course, the opening 60 can also be closed in a non-watertight manner and offers only a protection against contacting.

Figure 3:
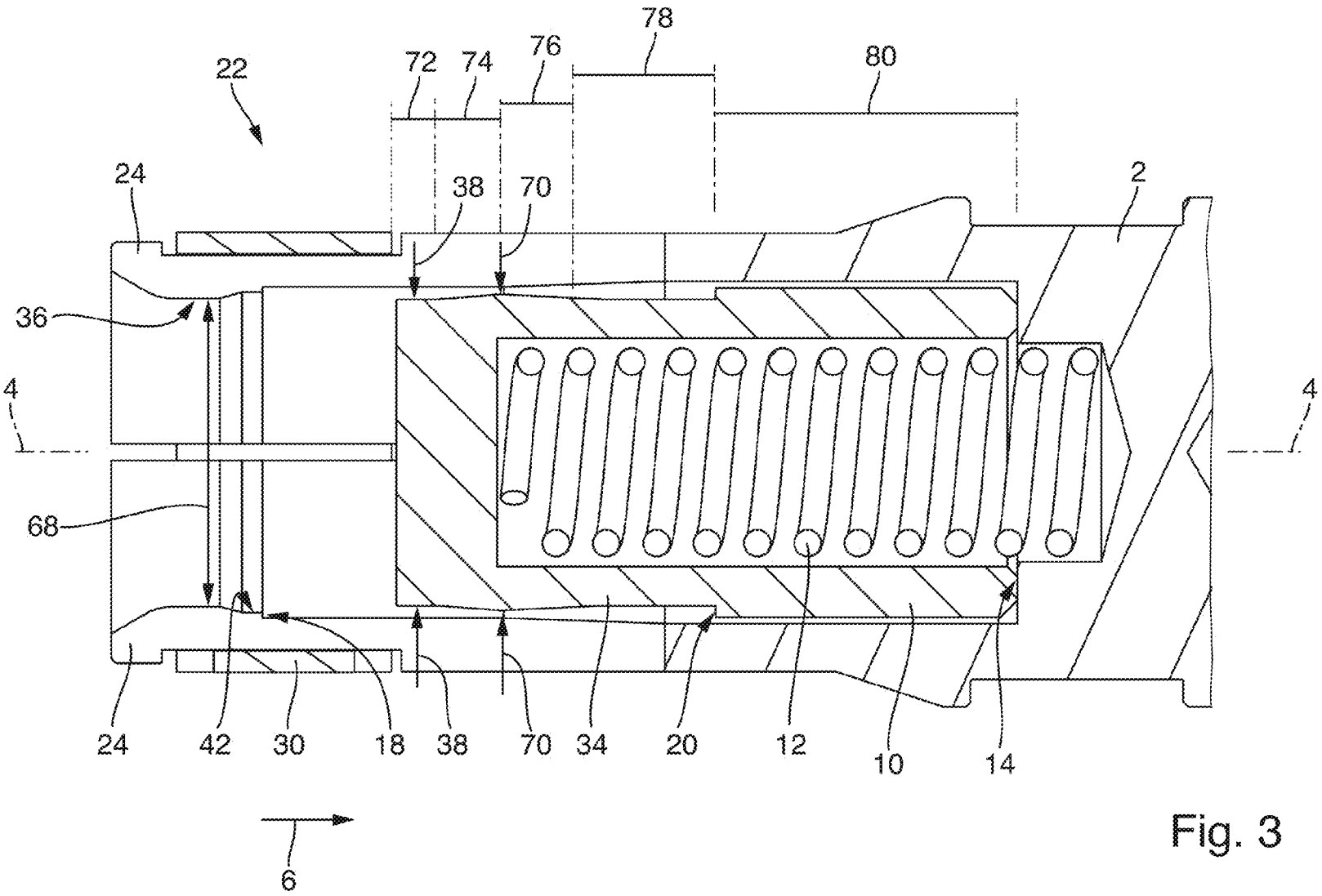
FIG. 3 shows a schematic sectional view of an implementation of an illustrative female contact, consistent with one or more aspects of the innovations herein.

FIG. 3 shows another embodiment of the female contact 2 in a schematic sectional view, according to another illustrative implementation herein. In distinction to FIG. 1, the distal section 34 of the closure element 10 has an increase in diameter 70 in plugging direction 6. The increase in diameter 70 corresponds in such a manner to the contact section 22 and in particular in such a manner to the inner contact surfaces 36 that the contact section 22 opens in advance upon a plugging procedure of the contact pin 52. This advance opening means that the contact webs, lip(s) or flange(s) 24 move radially outward via the increase in diameter 70 and therefore the contacting between the inner contact surface 36 and the contact pin 52 does not take place until the tip of the contact pin 52 has already passed the inner contact surfaces 36 during the introduction into the female contact 2.

A section 72 of the closure element 10 comprises the outside diameter 38*a*. If the closure element 10 is in a position in which it is in the area of the inner contact surfaces 36 with the outside diameter 38*a* then the inner contact surfaces 36 limit an inside diameter 68. Starting from the outside diameter 38*a* the diameter increases in a section 74 to the diameter increase 70. In a section 76 the outside diameter decreases again in plugging direction 6 in order to return in the proximal section 78 of the distal section 34 to the outside diameter 38*a*. A proximal section 80 of the closure element 10 follows the proximal section 78 of the distal section 34.

Figure 4:
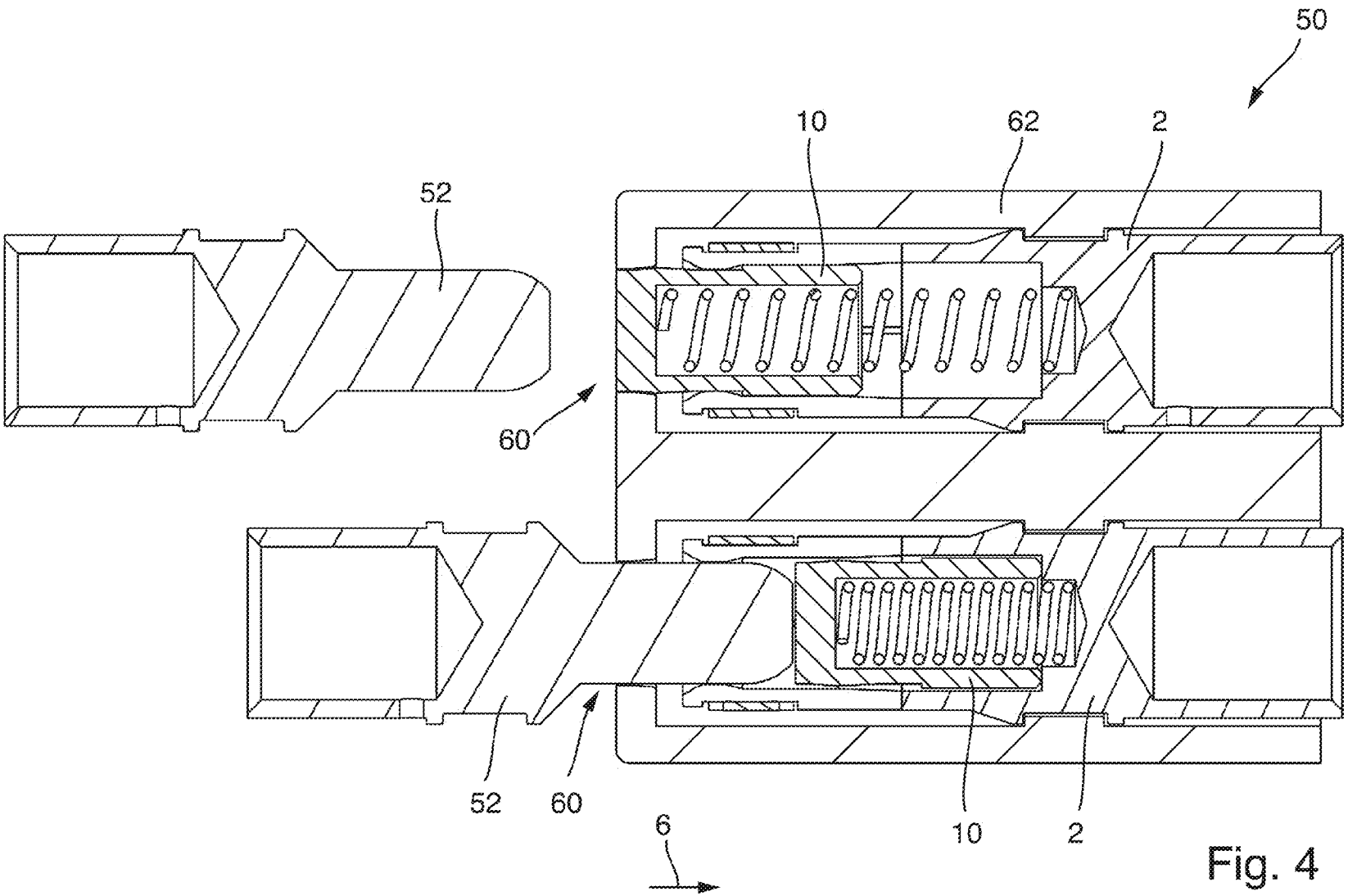
FIG. 4 show a schematic sectional view involving an illustrative plug-and-socket connector with the female contact, consistent with one or more aspects of the innovations herein.

FIG. 4 shows an embodiment of the plug-and-socket connector 50 analogous to FIG. 2, according to one illustrative implementation herein. In distinction to FIG. 2 the opening 60 is made in the insulating body 62. According to the embodiment shown, the opening 60 tapers outwardly as it extends into the body of the connector 50 in the plugging direction 6, as a result of which the sections 72 and 74 can be at least partially received in the opening 60.

In the above, the disclosure has mainly been described with reference to a limited number of embodiments. However, as is readily appreciated by a person skilled in the art, other embodiments than the ones disclosed above are equally possible within the scope of the disclosure, as defined by the appended claims.

The invention claimed is:

1. A plug-and-socket connector comprising:

an electrically conductive female contact shaped to receive a contact pin, comprising a contact section at a distal end, and having structure that establishes an electrical connection to the contact pin, wherein the female contact is accessible by an opening in the plug-and-socket connector; and a closure element for closing the opening, wherein the closure element is movably supported inside the female contact, wherein a distal section of the closure element increases in diameter in a plugging direction, and wherein the distal section engages the contact section, and wherein the contact section opens upon an advancing motion of the distal section during a plugging procedure of the contact pin.

2. The plug-and-socket connector according to claim 1, wherein the closure element is supported by a first pretensioning device on an opposing section of the female contact, wherein the first pretensioning device presses the closure element in the direction of the opening.

3. The plug-and-socket connector according to claim 2, wherein a second pretensioning device encompasses the contact section of the female contact in order to radially compress the contact section.

4. The plug-and-socket connector according to claim 3, wherein the distal section of the closure element is constructed as an outer support for the second pretensioning device.

5. The plug-and-socket connector according to claim 4, wherein the distal section of the closure element has an outside diameter which substantially corresponds to an outside diameter of the contact pin to be received and/or to an inside diameter of the opening.

6. The plug-and-socket connector according to claim 3, wherein the distal section of the closure element has an outside diameter which substantially corresponds to an outside diameter of the contact pin to be received and/or to an inside diameter of the opening.

7. The plug-and-socket connector according to claim 1, wherein the distal section decreases in diameter in the plugging direction after the increase in diameter.

8. The plug-and-socket connector according to claim 7, wherein the female contact is arranged inside an insulating body in a stationary manner and wherein the opening is constructed in a sealing element comprising silicone and different from the insulating body.

9. The plug-and-socket connector according to claim 8, wherein a material defining the opening, including the insulating body and the closure element, is constructed to be electrically insulating.

10. The plug-and-socket connector according to claim 1, wherein the female contact is arranged inside an insulating body of the plug-and-socket connector in a stationary manner and wherein the opening is constructed in a sealing element comprising silicone and different from the insulating body.

11. The plug-and-socket connector according to claim 1, wherein a material, defining the opening of an insulating body of the plug-and-socket connector and the closure element, is constructed to be electrically insulating.

* * * * *